United States Patent [19]

Airy et al.

[11] Patent Number: 4,801,138

[45] Date of Patent: Jan. 31, 1989

[54] WEARABLE APPARATUS FOR EXERCISING BODY JOINTS

[75] Inventors: James F. Airy; Thomas D. Kadavy, both of Bellevue, Wash.

[73] Assignee: Soma Dynamics Corporation, Bellevue, Wash.

[21] Appl. No.: 127,113

[22] Filed: Dec. 1, 1987

[51] Int. Cl.[4] ..... A63B 21/00; A63B 21/22; A61F 3/00

[52] U.S. Cl. ..... 272/130; 272/132; 128/25 R; 128/80 C

[58] Field of Search ..... 272/130, 70, 96, 93, 272/126, 94, 132; 128/25 R, 25 B, 80 C, 77, 80 R

[56] References Cited

U.S. PATENT DOCUMENTS

| | | | |
|---|---|---|---|
| 3,683,897 | 8/1972 | Shield et al. | 128/25 R |
| 3,976,057 | 8/1976 | Barclay | 128/25 R |
| 4,520,804 | 6/1985 | DiGeorge | 128/80 C |
| 4,651,719 | 3/1987 | Funk et al. | 128/25 R |

*Primary Examiner*—Richard J. Apley

*Assistant Examiner*—S. R. Crow

*Attorney, Agent, or Firm*—Christensen, O'Connor, Johnson & Kindness

[57] ABSTRACT

A portable appliance (10) which is worn by the user to exercise a body joint includes an articulating frame (12) composed of a pair of laterally, spaced-apart pivot arms (14*a*, 14*b*) connectible to a first limb of the body joint and pinned to a second pair of spaced-apart pivot arms (16*a*, 16*b*) connectible to the second limb of the body joint. A rotatably actuated, fluid cylinder assembly (22) is mounted on the first pivot arms (14*a*, 14*b*) on the extendible side of the body joint. The cylinder assembly (22) includes a piston (24) threadably engaged within an elongated piston rod (26). A transmission system transmits the relative rotational movement between the frame arms (14*a*, 14*b*) and the frame arms (16*a*, 16*b*) to the piston rod (26) thereby to actuate the piston (24). Adjustable flow control devices control the flow of fluid within the cylinder assembly (22) to apply isotonic, isokinetic or dynamic resistance to the flexing or extending of the body joint being exercised.

43 Claims, 6 Drawing Sheets

Fig. 6.
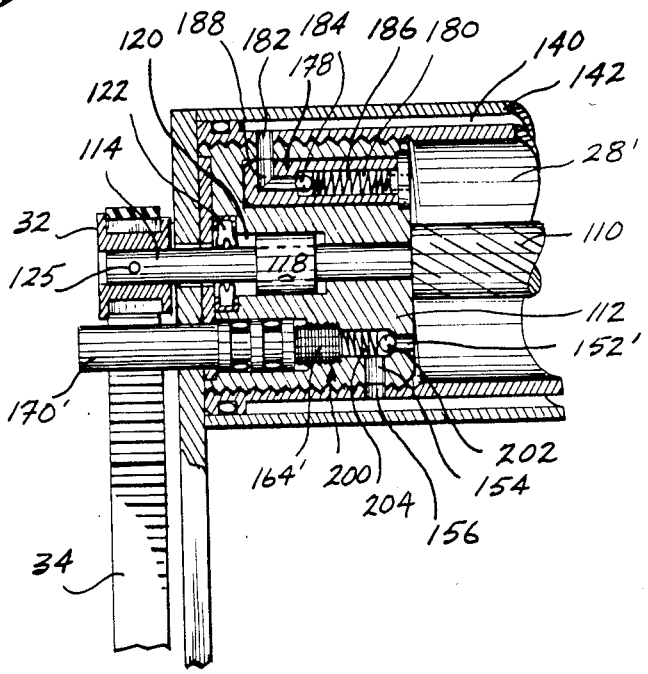
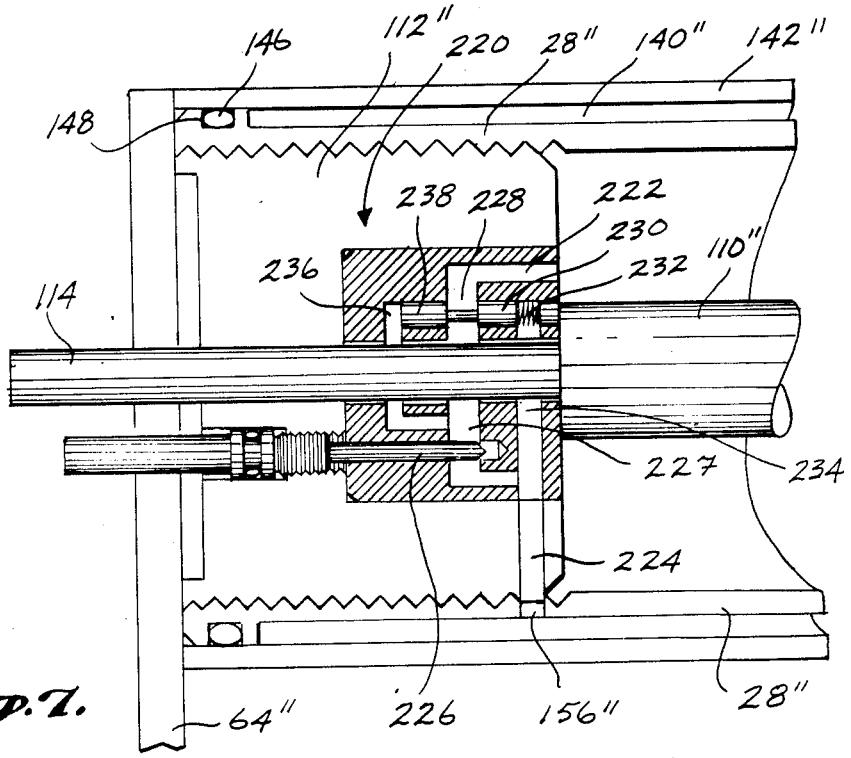
Fig. 7.

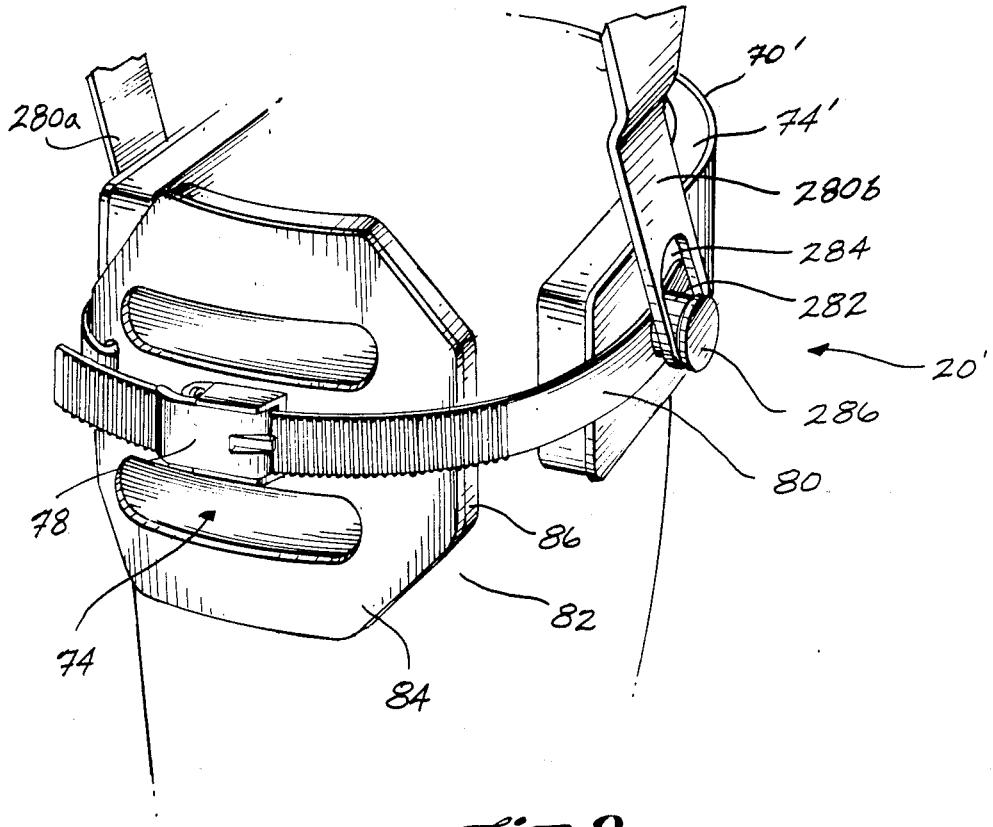
fig. 9.
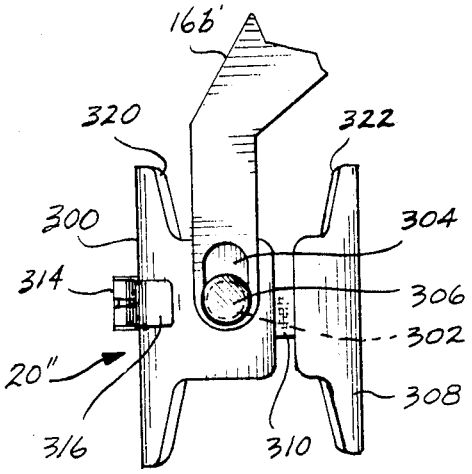
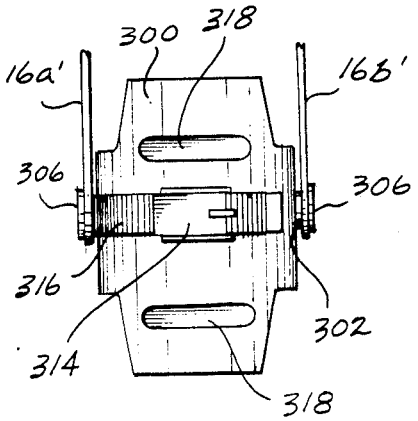
fig. 10. fig. 11.

WEARABLE APPARATUS FOR EXERCISING BODY JOINTS

FIELD OF THE INVENTION

The present invention concerns fitness and rehabilitation devices, and more particularly, a fitness and/or rehabilitation apparatus for exercising a body joint wherein the apparatus is worn by the user so that exercise and therapy can occur during specific exercises or therapy regimes and also during normal activities.

BACKGROUND OF THE INVENTION

It is estimated that over 100,000,000 Americans currently participate regularly in at least one physical sport or conditioning activity. Physical fitness has now become a permanent part of the life of millions of people. Nonetheless, the equipment available for use in conditioning has not developed significantly. Typical types of equipment include weight machines, exercise bicycles, rowing machines, treadmills, home gyms, etc. Although these products are of some utility, they have significant drawbacks. For instance, they do not provide functional conditioning, i.e., they condition muscles to operate the equipment, but not necessarily to run, walk, swim, golf or play tennis. Moreover, most current physical fitness equipment is not only heavy, bulky and expensive, but also timeconsuming, boring and sometimes even dangerous to use.

With the advent of greater emphasis in physical fitness, a corresponding increase in musculoskeletal injuries has occurred, especially to the knee, ankle, elbow, wrist and other body joints. According to the National Center for Disease Statistics, in 1985 over 420,000 knee injuries requiring orthopedic treatment were reported. In addition, over 340,000 serious musculoskeletal injuries to the ankle, elbow, shoulder and other joints were reported.

Part of a typical process for rehabilitating an injured body joint is to flex and exercise the joint under controlled load levels. This treatment is usually given at the facilities of a physical therapist or clinic specializing in sports-related injuries. Sophisticated, expensive machines have been developed for use in rehabilitating the muscles, ligaments and other tissues of an injured or otherwise damaged body joint. However, to use these machines the patient must leave his place of employment or home to travel to the office or clinic of the therapist or sports medicine doctor. Examples of specialized, stationary machines that have been designed for conditioning and rehabilitating body joints are disclosed in U.S. Pat. Nos. 3,495,824, 4,407,496 and 4,436,303.

Some less bulky devices also have been developed for exercising or rehabilitating body joints. In one such type of device, two pivotally connected lever arms are strapped to the two limbs of the body joint. A brake mechanism is attached to and extends laterally outwardly from the pivot arms to resist the relative movement of the arms and, thus, impart a resistance force against movement of the body joint. Two examples of this type of device are disclosed by U.S. Pat. Nos. 2,832,334 and 3,976,057. As with the specialized, stationary conditioning and rehabilitating machines noted above, these devices, though less bulky, still suffer from the drawback that they are useful only for specific exercises, rather than during normal work or other daily activities.

SUMMARY OF THE INVENTION

The foregoing limitations of known exercise and therapeutic devices are addressed by the present invention which provides a portable, lightweight, exercise apparatus/rehabilitation appliance that is worn by the user and used to selectively impart desired levels of resistance to the flexing and extending of a body joint. The apparatus/appliance includes a frame structure which is entirely carried by the body. The frame structure is composed of first and second pivot arms that are pivotally connected about a pivot axis to enable the arms to pivot relative to each other in a first direction and in a second direction opposite to the first direction. The frame is placed on the body to connect the first and second pivot arms to respective first and second limbs of the body joint so that the pivot axis of the frame is in approximate alignment with the pivot axis of the body joint. A fluid resistance mechanism to resist the relative pivotal movement between the first and second pivot arms and, thus, between the first and second limbs of the body, is mounted at a location spaced from and along the pivot axis of the body joint so as not to interfere with the sides of the limbs of the body. The relative rotational movement occurring between the first and second pivot arms as the body joint is flexed or extended is transmitted to the fluid resistance mechanism thereby to generate a resistance force in opposition to the pivotal movement of the body joint.

In a further aspect of the present invention, the fluid resistance mechanism includes a rotationally actuated cylinder assembly which is mounted on either the first or second pivot arms. The fluid cylinder assembly includes a piston that is threadably engaged with a piston rod extending longitudinally through a first, inner cylinder so that upon rotation of the piston rod, the piston slides along the first cylinder. The relative rotational movement between the first and second pivot arms is transmitted to the end of the piston rod by a power transmission system composed of a first pulley mounted on the other of the two pivot arms then the pivot arm that the cylinder assembly is mounted on, with the first pulley rotating with such other pivot arm. A second pulley is mounted on the end of the piston rod and a belt is trained around the two pulleys thereby to transmit rotational motion from the first pulley to the second pulley for rotation of the cylinder rod and, thus, sliding movement of the piston along the first fluid cylinder.

In a further aspect of the present invention a second, outer cylinder surrounds the first cylinder to form an annularly-shaped reservoir therebetween. Fluid flow passageways extend between each end of the inner cylinder and the annular reservoir to receive fluid from the end of the inner cylinder that the piston is traveling toward and to transmit the fluid from the reservoir to the opposite end of the first cylinder, i.e., the end from which the piston is traveling away.

In an additional aspect of the present invention, adjustable flow control devices control the flow of fluid from the ends of the inner cylinder to and from the annular reservoir. The flow control devices may be adjusted to independently control the force required to rotate the first and second arms in their first and second relative directions of motion and, thus, in turn independently control the physical effort needed to flex or extend the body joint. The flow control devices may be of various types, including a first, isotonic type designed to impart a constant resistance load on the piston and, thus, also on the pivot arms of the frame and the limbs of the body joint. In a second, isokinetic type of flow control device, the maximum speed that the piston is allowed to travel within the cylinder is limited, thereby correspondingly controlling the speed at which the pivot arms and, thus, also the body limbs, may rotate relative to each other. This type of speed control is an important aspect of certain exercise used in rehabilitating body joints. A third type of flow control device imparts a resistance load on the piston in proportion to the speed of travel of the piston. This "dynamic" loading is thus also applied to the pivot arms and to the limbs of the body joint.

BRIEF DESCRIPTION OF THE DRAWINGS

The details of typical embodiments of the present invention will be described in connection with the accompanying drawings, in which:

FIG. 6 is a fragmentary, cross-sectional view of the fluid cylinder assembly shown in FIG. 2 illustrating an alternative embodiment of the present invention;

FIG. 7 is a further fragmentary, cross-sectional view of the fluid cylinder assembly shown in FIG. 2 illustrating another preferred embodiment of the present invention;

FIG. 9 is a fragmentary, isometric view of yet another preferred embodiment of the present invention;

FIG. 10 is a fragmentary, side elevational view of a further preferred embodiment of the present invention illustrating an alternative construction of the lower cuff assembly; and, FIG. 11 is a fragmentary, front elevational view of FIG. 10.

DETAILED DESCRIPTION

Figure 1:
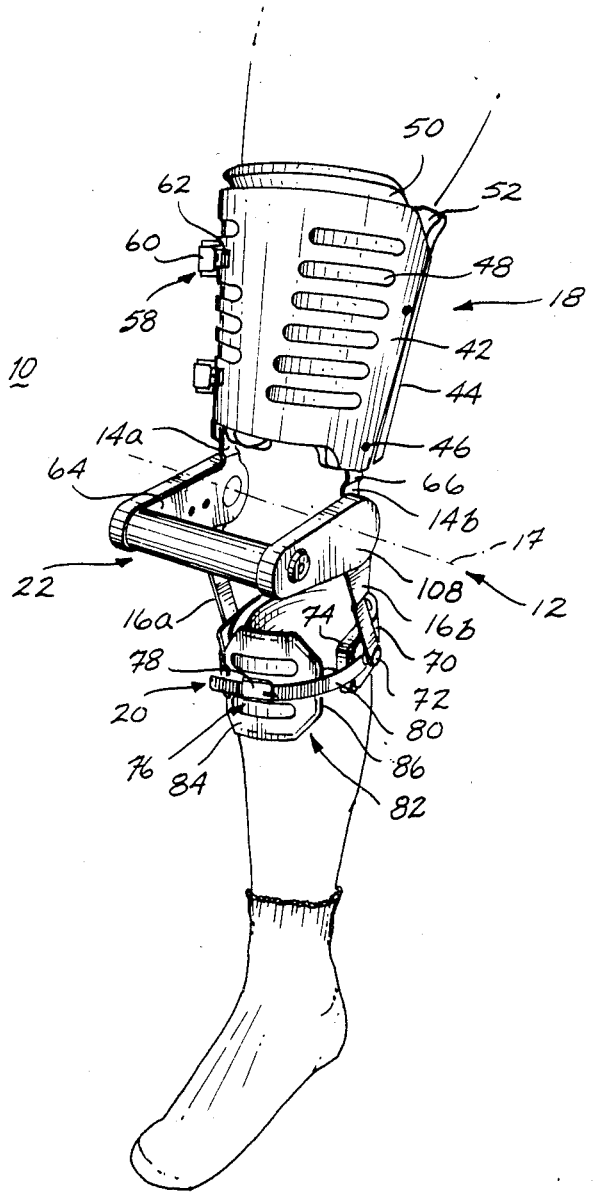
FIG. 1 is an isometric view of the present invention adapted to exercise a knee joint.
Figure 2:
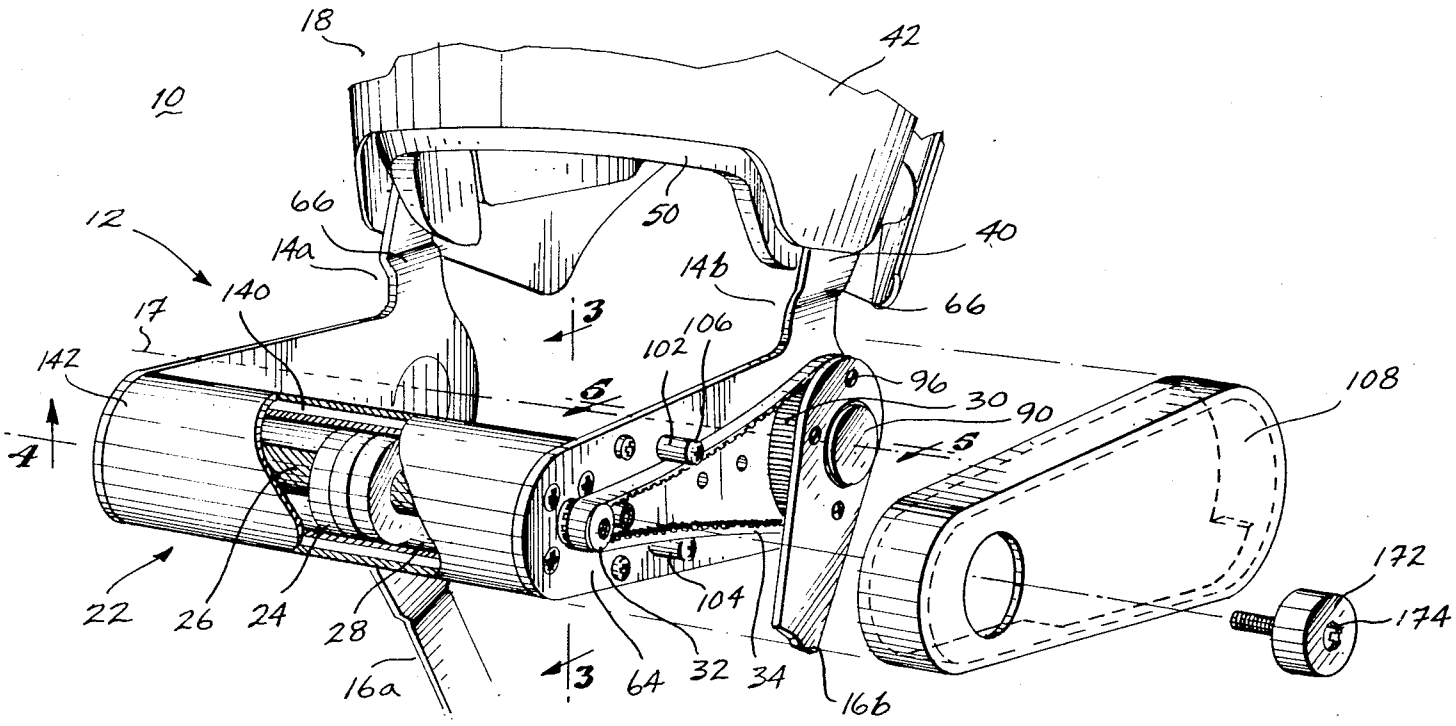
FIG. 2 is an enlarged, fragmentary, isometric view of the present invention shown in FIG. 1 to more specifically illustrate the construction of the fluid cylinder assembly and transmission mechanism.

Referring initially to FIGS. 1 and 2, a portable body joint exercising appliance or apparatus 10 is illustrated for use in conjunction with the knee joint. However, it is to be understood that the present invention may be adapted for and used in conjunction with other body joints, such as the ankle, elbow or wrist. As shown in FIGS. 1 and 2, in basic form, the exercising apparatus 10 includes an articulating frame 12 composed of a pair of flat, laterally, spaced-apart upper angle arms **14*a* and 14*b* pivotally pinned to a pair of corresponding spaced-apart lower arms 16*a* and 16*b* so as to pivot about a transverse axis 17. The axis 17 is positioned in approximate alignment with the axis of rotation of the knee by an upper cuff assembly 18 connected to the upper portions of the arms 14*a* and 14*b* to encircle the portion of the thigh adjacent the knee and a lower cuff assembly 20 connected to the lower ends of the lower arms 16*a* and 16*b* to encircle the calf just below the knee. Selectively adjustable levels of resistance to the flexing and extending of the knee joint is provided by a fluid cylinder assembly 22, which is mounted on the upper angle arms 14*a* and 14*b* at a location spaced slightly forwardly of the knee to extend alongside the axis of rotation of the knee. The cylinder assembly 22 includes a piston 24 threadably engaged with an elongated piston rod 26 whereby upon rotation of the piston rod, the piston 24 slides along the interior of an inner cylinder 28. A transmission system transmits the relative rotational movement between the lower arms 16*a* and 16*b* and the upper arms 14*a* and 14*b* to the piston rod 26 thereby to actuate the piston 24. This is accomplished through the use of drive pulleys 30 secured to the upper ends of lower arms 16*a* and 16*b*, smaller driven pulleys mounted on the outer ends of the piston rod 26 and the drive belts 34 trained around the pulleys 30 and 32** to transmit rotational movement therebetween.

In use, the upper and lower cuff assemblies 18 and 20 are placed around the lower thigh and upper calf of the user to align the pivot axis 17 of the frame 12 with the rotational axis of the knee joint. The knee joint is exercised simply by flexing and extending the leg in opposition to the resistance to the relative pivotal movement of the frame 12 generated by the cylinder assembly 22. The apparatus 10 can be used to exercise the knee during specific exercising regimes or routines; however, perhaps more importantly is also can be worn during normal activities to provide exercise throughout the day whenever the knee is flexed or extended.

Next, considering the construction of the exercising appliance/apparatus 10 in more detail, as shown most clearly in FIGS. 1 and 2, the upper angle arms **14*a* and 14*b* of the pivot frame 12 include flat, elongate, upwardly extending sections 40, which are attached to the forward and rearward outer, formed shell members 42 and 44, respectively, of the upper cuff assembly 18. Arm 14*b* is fastened to the adjacent "inside" edge portions of the shell members 42 and 44 by conventional fastener members, such as rivets 46. On the "outside" of the apparatus 10, only the forward shell member 42 is attached to arm 14a thereby to enable the shell members to be opened when donning or duffing the apparatus. Preferably, the shell members 42 and 44 are formed to cooperatively define circular, frustoconical shape to approximate the shape of the lower thigh of the wearer. Although not essential, ideally to minimize the weight of the apparatus 10 and to provide ventilation, a series of slots 48 or other type or shape of openings may be formed in the shell members 42 and 44. Resilient padding 50 and 52 is mounted on the inside surfaces of the forward and rearward shell members 42 and 44, respectively, to provide comfort to the wearer and to snugly fit the cuff assembly 18 around the leg. The padding may be composed of appropriate resilient materials, such as foamed rubber or plastic. For improved fit, an air bladder, not shown, may be used in conjunction with or as an alternative to the padding 50 and/or 52. The air bladder could be provided with a standard valve and stem for directing air into and out of the bladder. Both the padding 50 and 52** and the air bladder ideally are removably secured to the shell members so that they can be sized to accommodate the size and shape of a wearer's leg and also replaced when worn.

As most clearly shown in FIG. 1, the two shell members 42 and 44 of the upper cuff assembly 18 are clamped around the lower thigh of the wearer by a pair of spaced-apart, quick release latch assemblies 58 secured to the outward side edge portions of the forward and rearward shell members 42 and 44. The latch assemblies 58 may be of any appropriate construction and include a latch or buckle 60 mounted on either the forward or rearward shell member to engage with a corresponding strap 62 mounted on the other shell member. The two shell members 42 and 44 are flexible enough to enable the upper cuff assembly to be conveniently opened and placed around the thigh when donning apparatus 10 even though the inward or closed side edge portions of the shell members are attached to arm 14*b*.

Continuing to refer specifically to FIGS. 1 and 2, the upper arms 14*a* and 14*b* also include elongated, flat, forwardly extending sections 64 disposed in spaced parallel relationship to each other for mounting the cylinder assembly 22 at a location spaced slightly forwardly of the knee. This location is designated as the "extendible" side of the knee joint in that the leg members rotate in this direction about the knee joint as the leg is being extended. For the same reason the opposite side of the leg will be referred to as the "flexural" size. An offset bend 66 is formed at the juncture of the upper sections 40 and the lower forward sections 64 of the upper arms 14*a* and 14*b* to maintain the forward sections 64 in spaced parallel relationship to each other while enabling the upper sections to flare outwardly relative to each other to accommodate the increasing width of the thigh in the direction upwardly from the knee.

As shown in FIG. 1, the lower cuff assembly 20 is composed of a generally U-shaped, outer shell member 70 pivotally attached to the lower ends of the lower pivot arms 16*a* and 16*b* by pivot pins 72 which allow the shell member to pivot somewhat about the lower arms to accommodate the shape of the wearer's leg. The U-shaped shell member 70 is designed to encircle the rear and side portions of the wearer's leg at the upper portion of the calf. For comfort, ideally a resilient pad 74 extends around the inside surface of the shell member 70. The lower cuff assembly 20 is secured in place by a quick release latch assembly 76 composed of a buckle 78 and a strap 80 which extend forwardly around the lower leg of the wearer. Ideally, a forward pad 82 is carried by either the buckle 78 or the strap 80 to bear against the front of the lower leg to distribute the clamping force of the latch assembly about a substantial area of the leg to avoid pinching, bruising or otherwise injuring the leg. As shown in FIG. 1, preferably the forward pad 82 is constructed with a contoured outer shell member 84 and an underlying resilient pad 86 preferably formed from foam rubber, foam plastic or other appropriate resilient material. Preferably, shell 84, U-shaped shell member 70 and the forward and rearward shell members 42 and 44 of the upper cuff assembly 20 are formed from lightweight, high strength material that is formable or moldable into desired shapes. Examples of such materials might include certain metals, such as aluminum and various plastics, such as polypropylene or ABS.

Figure 5:
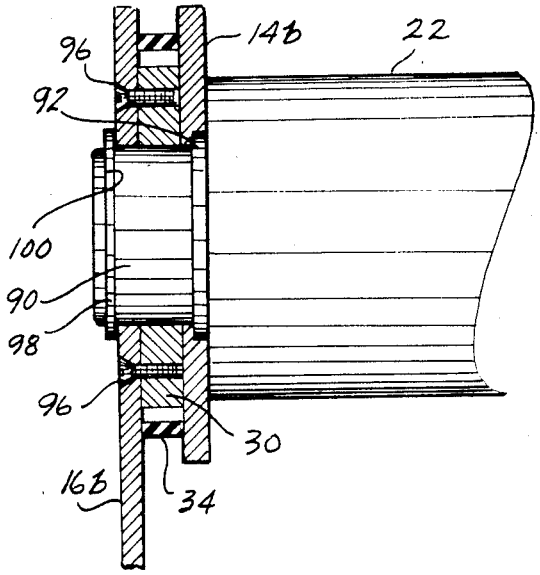
FIG. 5 is an enlarged, fragmentary, cross-sectional view of the joint assembly utilized in the apparatus of the present invention and taken substantially along lines 5—5 of FIG. 2.

Next, referring to FIG. 5, the upper angle arms 14*a* and 14*b* are pivotally connected to the upper ends of the lower pivot arms 16*a* and 16*b* to articulate about axis 17 by a pair of pivot shafts 90 extending through aligned, close-fitting openings formed in the upper and lower arms. The pivot shafts 90 are formed with enlarged rims 92 that engage within counterbores formed in the upper arms 14*a* and 14*b*. The pivot shafts 90 also extend through the central interiors of cogged drive pulleys 30 positioned between the upper and lower pivot arms. The pulleys 30 are secured to the upper ends of the lower pivot arms 16*a* and 16*b* by fasteners, such as screws 96, extending through close-fitting clearance holes formed in the lower arms to engage into aligned, tapped holes formed in the drive pulleys 30. The pivot shafts 90 are held in place by snap rings 98 engaged within snap ring grooves 100 formed in the outward end portions of the pivot shafts 90. The pivot shafts 90 are constructed from relatively large diameters to permit the upper pivot arms 14*a* and 14*b* to freely pivot relative to the respective lower pivot arms 16*a* and 16*b* while minimizing any relative twisting movement between the pivot arms about axis extending in directions other than along the pivot axis 17.

As shown in FIG. 2, drive pulleys 30 are disposed in alignment with driven pulleys 32 mounted on the outer end portions of the piston rod 26 that extend outwardly beyond upper arm forward sections 64. Preferably, the drive and driven pulleys 30 and 32 are adapted to train with a cog or timing belt 34. Such belts have the advantage that they may be engaged over relatively small diameter pulleys without premature wear due to high flexural stresses, they exhibit very little backlash and they are capable of efficiently transmitting relatively high loads. Nonetheless, other types of belts may be used in place of the cog belt 34 without departing from the scope of the present invention.

A pair of spaced-apart idler rollers 102 and 104 bear against the outward, flat surfaces of each belt 34 to guide the belt, to increase the wrap angle of the belt around the smaller driven pulley 32 and to impose a desired tension on the belt. The idler rollers 102 and 104 are mounted on pins 106 that project outwardly from the sides of the forward sections 64 of the upper arms 14*a* and 14*b*, FIG. 2. The idler rollers 102 and 104 can be replaced with idler rollers of larger or smaller diameters to increase or decrease, respectively, the tension on the belt 34. Preferably, the idler rollers 102 and 104 are formed from a low friction, self-lubricating material, such as nylon. Formed covers 108 are provided to enclose the pulleys 30 and 32, the belt 34 and the rollers 102 and 104 to protect these components. The covers 108 extend along the entire lengths of the forward sections 64 of the upper arms 14*a* and 14*b* and may be attached to the forward sections by any convenient method. Appropriate slots are provided in the lower rims 109 of the covers to provide clearance for the movement of the upper ends of the lower arms 16*a* and 16*b*.

Next, considering the construction of fluid cylinder assembly 22 in greater detail, a piston 24 is disposed within the interior of a close-fitting inner or first cylinder 28 and is adapted to slide back and forth along the cylinder by rotation of a piston rod 26. The piston rod 26 has an enlarged central portion 110 formed with high helix angle external threads to engage with the correspondingly threaded central interior of the piston 24. By virtue of the high helix angle of the piston rod threads, a relatively small rotation of the piston rod results in the piston 24 being shifted a substantial distance along the length of the inner cylinder 28. The piston rod 26 is supported at its end portions by relatively thick, cylindrically-shaped end caps 112 having a threaded exterior for engaging with mating internal threads formed within the ends of the first or inner cylinder 28. The piston rod 26 is constructed with reduced diameter end portions 114 that engage through close-fitting central bores 116 formed in the end caps 112. Bushings 118 are pressed within inner counterbores 120 formed in the end caps 112 to antifrictionally receive the end portions 114 of the piston rod 26. Seals 122 are pressed into outer counterbores 124 formed in the end caps 112 to seal against the reduced diameter sections 114 of the piston rod. Driven pulleys 32 are secured to the outward ends of the piston rod reduced diameter sections 114 by any convenient method, such as by the use of roll pins 125 engaged within holes extending diametrically through the driven pulleys and through aligned cross holes formed in the piston rod. The piston 24 is prevented from rotating relative to the piston rod 26 by a guide rod 126 extending through a close-fitting clearance opening formed in the piston 24 at a location offset in the forward direction (relative to apparatus 10) from the central bore of the piston through which the rod 26 extends. The ends of the guide rod 126 are engaged with aligned bores extending through end caps 112. The piston 24 is constructed with a central groove 130 extending around the outer circumference of the piston for reception of a seal 132 to minimize the amount of fluid that leaks past the piston as it travels back and forth along the cylinder 28. Preferably, the seal 132 is coated with a low friction material, such as Teflon®. The seal 132 is loaded against the cylinder 28 by an O-ring 134 which is positioned within the groove 130 beneath the seal.

An annular chamber 140 is formed around the outer circumference of the inner cylinder 28 by an outer cylinder 142 having an inside diameter slightly larger than the outside diameter of the inner cylinder. A radially, outwardly extending shoulder 144 is formed at each end of the inner cylinder 28 to closely fit within the inside diameter of the outer cylinder 142, thereby to space the outer and inner cylinders relative to each other. An O-ring seal 146 is seated within a groove 148 formed within each shoulder 144, thereby to prevent the leakage of fluid between the inner and outer cylinders.

The fluid cylinder assembly 22 is mounted on the forward ends of arm sections 64 by a plurality of threaded fasteners 149 which extend through clearance holes formed in the forward sections 64 to engage with aligned, tapped, blind holes formed in the cylinder end caps 112. The forward ends of the arm sections 64 are shaped and sized to bear against the ends of the inner and outer cylinders 28 and 142. It will be appreciated that by this construction the cylinder assembly 22 serves as a structural component of frame 12 to enhance rigidity and structural integrity for the frame.

Figures 3, 4:
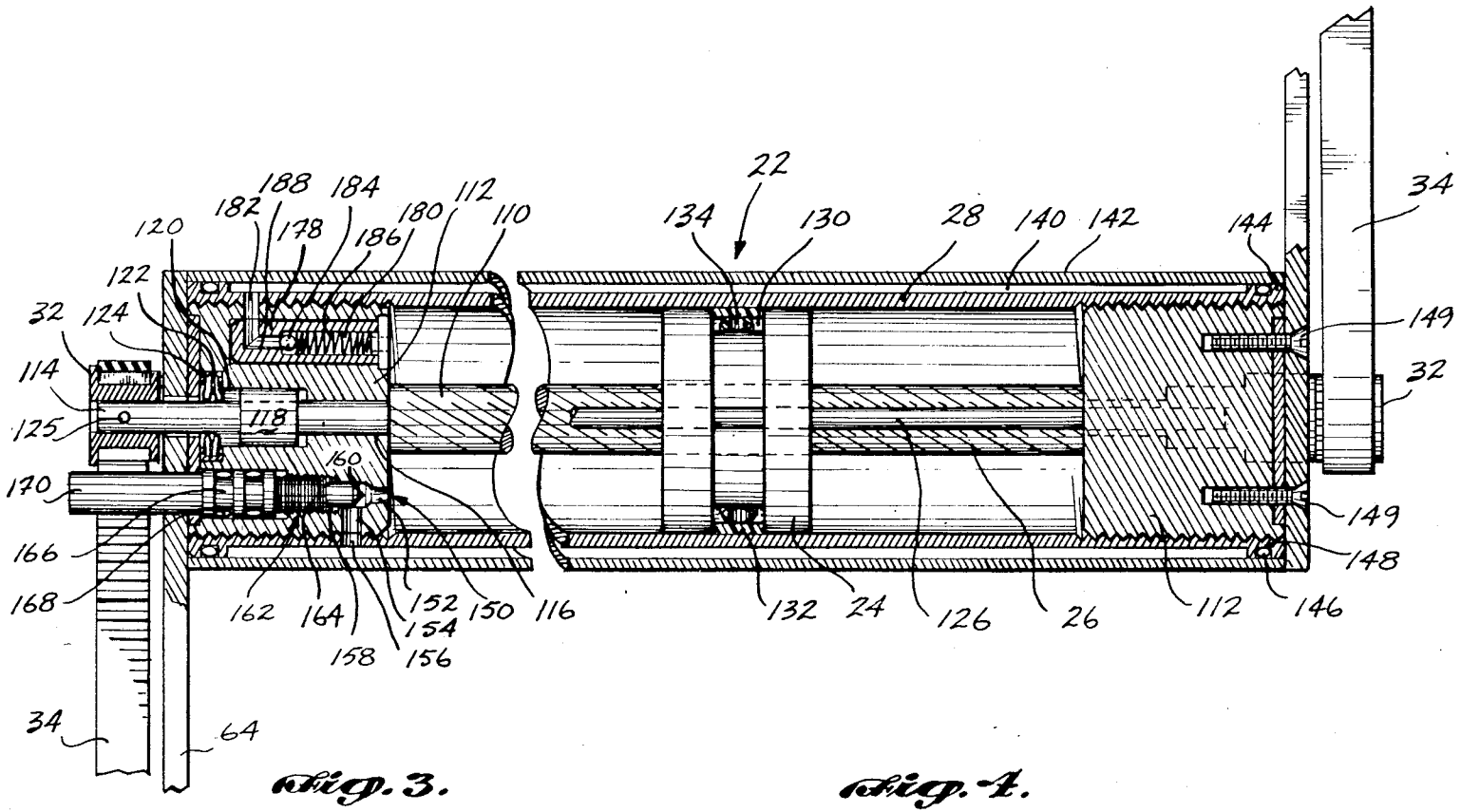
FIG. 3 is an enlarged, fragmentary, cross-sectional view of the fluid cylinder assembly shown in FIG. 2 and taken substantially along lines 3—3 thereof.
FIG. 4 is another enlarged, fragmentary, cross-sectional view of the fluid cylinder assembly shown in FIG. 2 and taken substantially along lines 4—4 thereof.

Fluid cylinder 22 is of the double-acting type and, thus, as piston 24 slides along cylinder 28, the fluid in front of the approaching piston is routed through an end cap 112 to chamber 140 while at the same time fluid from the chamber 140 is routed through the opposite end cap 112 and into the cylinder 128 at the back side of the piston. As shown in FIGS. 3 and 4, the end caps 112 each include a fluid exit passageway 150 having a longitudinal section 152 in communication with the interior of piston 28 and a larger diameter radial section 154 in communication with an aligned opening 156 formed in the inner cylinder 128. The smaller diameter longitudinal section 152 of the passageway 150 serves as a restriction orifice for the fluid passing through the passageway. The exit passageway at the intersection of the longitudinal and radial sections 152 and 154, is formed as a longitudinal, larger diameter section 158 to receive the pointed tip 160 of a needle valve 162. The needle valve includes a threaded shank section 164 that engages with corresponding threads formed in the end cap. The needle valve also includes a pair of O-ring grooves 166 located on the shank portion of the needle valve opposite tip 160 (i.e., outwardly of threads 164) for reception of a pair of closefitting O-rings 168 which minimize the possibility that fluid will leak past the needle valve. The needle valve also includes a distal end section 170 that extends outwardly from the end cap 112 through a clearance opening formed in the forward end of each arm section 64 to receive a knob 172 which may be manually rotated to adjust the engagement of the needle valve 162 within fluid passageway 158. A threaded hardware member extends through a central clearance opening formed in the knob 172 to engage into the threaded interior of end section 170 to attach the knob to the end section.

The end caps 112 also include check valves 178 to allow the fluid in the chamber 140 to flow into the interior of the inner cylinder 28 as the piston 24 is moving away from the check valve while preventing the fluid from flowing in the opposite direction as the piston is moving toward the check valve. Each of the check valves 178 includes a flow passageway 180 in communication with the interior of cylinder 28 and also in communication with a radial opening 182 extending through the wall of inner cylinder 28 to interconnect the passageway 180 with the chamber 140. The check valve 178 further includes a ball 182 resiliently loaded by spring 184 against the reduced diameter section 188 of passageway 180. It will be appreciated that ball 184 only permits fluid to flow from chamber 140 into cylinder 82 and not vice versa.

By the foregoing construction, exercise apparatus 10 of the present invention may be conveniently adjusted to selectively and independently vary the level of effort required to flex the leg and extend the leg. This is important in that the muscles used to extend the leg are substantially stronger than those used to flex the leg. This dual adjustability capability is made possible by utilizing an adjustable needle valve 162 in conjunction with each of the two cylinder assembly end caps 112. The needle valves 162 vary the effective size of the orifices defined by the longitudinal sections 152 of exit passageways 150 by simply rotating knobs 172 attached to the outer ends of the needle valves 162.

It will be appreciated that the needle valves 162 provide a dynamic, variable level of resistance to the extension and flexion of the knee joint so that the faster the joint is extended or flexed, the higher the level of resistance to movement experienced by the joint. This results because as the joint is extended or flexed at a faster speed, the rotational speed of the upper angle arms **14*a* and 14*b* increases relative to the lower arms 16*a* and 16*b* causing drive pulley 30 to rotate faster, which in turn increases the rotational speed of piston rod 26, which in turn induces the piston rod 24 to slide at a faster speed within cylinder 28. However, since the orifice 152 in end caps 112 are of a fixed, relatively small diameter in relationship to the cross-sectional area of cylinder 28, the flow rate of fluid passing through orifice 152 is restricted causing an increase in fluid pressure to develop within the cylinder 28, which resists the movement of piston 24 and, thus, the rotation of piston rod 26, which resistance in turn is transmitted back through belt 34 from driven pulley 32 to drive pulley 30 and their associated lower pivot arms 16a and 16b**, thereby to place an increased resistance force against the movement of the joint. This type of dynamic resistance is desirable in that the speed at which the knee is flexed and extended is generally related to the muscle capacity available at the different positions of the leg. Through the present invention, the level of resistance imparted against the muscles corresponds to the instantaneous ability of the muscles to flex and extend the leg. As such, the muscles are neither overworked nor underworked.

It is to be understood that needle valves 162 may be replaced with a rotatable orifice plate, not shown, having a plurality of various diameter orifice openings spaced apart from each other about the center of the orifice plate and in alignment with the fluid exit passageway 150. The orifice plate may be rotated about its center to place an orifice of a desired size in registry with the passageway 150 thereby to impose a selected level of resistance to the extension and flexion of the knee joint.

FIG. 6 illustrates an alternative preferred embodiment of the present invention wherein the needle valve 162 illustrated in FIG. 3 is replaced with a spring-loaded ball valve 200 having a ball 202 nominally urged against orifice 152' by a compression spring 204 which is forced against the ball by a threaded shaft 206. As with the needle valve 162, a knob 172 is attached to the outer end of the shaft 206 by a screw 174. The valve 200 is designed to utilize the apparatus 10 as an isotonic (constant load) device. As the body joint is flexed or extended at a faster or slower speed, the fluid from the cylinder 28' flowing through the orifice 152' is correspondingly increased or decreased so that the apparatus 10 provides a constant resistance to the flexing or extending movement of the leg. As the fluid flow from the cylinder 28' increases, the ball 202 is retracted against the spring 204 to increase the effective area of the orifice 152', and conversely when the flow of fluid through the orifice is decreased, the force on the ball 202 by the fluid flowing through the orifice is reduced thereby causing the ball to extend forwardly under the urging force of the spring 204 to reduce the effective area of the orifice 152'. The desired level of resistance to the movement of the body joint is selectively controlled by rotation of the valve shaft 206 to advance or retract the shaft to in turn increase and decrease, respectively, the load applied to ball 202 by the spring 204.

In a further preferred embodiment of the present invention illustrated in FIG. 7, a pressure compensated flow control valve 220 is utilized to permit the apparatus 10 to pivot at a constant speed about axis 17 even though the wearer of the apparatus expends different levels of effort in extending or flexing the leg. Valve 220 is integrated into end cap 112" to replace the needle valve 162 shown in FIG. 3. The valve includes an inlet 222 in communication with the interior of cylinder 28" and an outlet 224 in communication with an opening 156" formed in the wall of cylinder 28" leading to the annular chamber 140". A metering needle 226 is disposed across the path 227 of fluid flowing through valve 220 to control the maximum flow rate of fluid through the valve. Also, a compensating spool 228 is disposed within a cavity 229 extending transversely across the fluid flow path 227. One end 230 of spool 228 bears against a compression spring 232 which extends across a feedback passageway 234 which is in fluid flow communication with outlet 224. A second feedback passageway 236 is in communication with the opposite end 238 of the spool 228 to sense the fluid pressure immediately upstream of needle valve 226. The position of the compensating spool 228 varies in response to the pressure of the fluid at inlet 222 so that with the higher the pressure of the fluid at the inlet, the valve shifts to reduce the effective area of the fluid path and with a reduction in the pressure of the fluid at inlet 222 the compensating spool 228 moves in the opposite direction to increase the effective area of the fluid path through the valve so that a substantially constant volume of fluid is discharged at outlet 224. Pressure-compensating flow control valves, such as valve 220 are standard articles of commerce. As noted above, in certain types of therapeutic treatments for injuries to body joints, the joint is exercised by flexion and extension at a constant speed. Apparatus 10 may be adapted for this type of treatment by employing the pressure compensated flow control valve 220.

Figure 8:
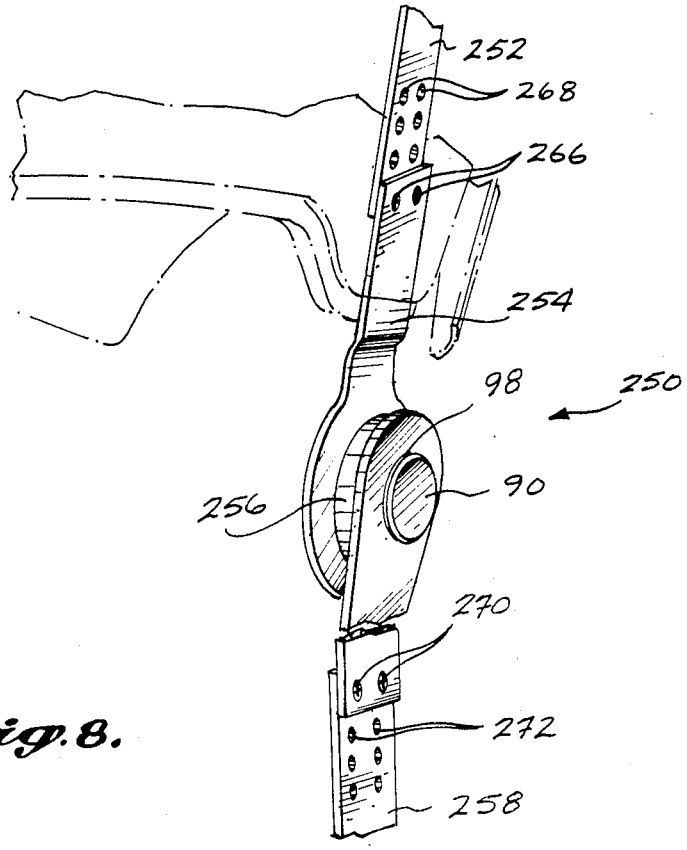
FIG. 8 is a fragmentary, isometric view illustrating an additional embodiment wherein the present invention may be utilized as a simple knee brace.

In another preferred embodiment of the present invention, as shown in FIG. 8, the fluid cylinder assembly 22 shown in FIGS. 1–4, is replaced by a pivot joint 250 to enable the apparatus 10 to be employed as a simple knee brace. In the joint 250, the lower end of the upper pivot arm 252, corresponding to arm 14, is detachably connected to a stub member 254 by screws 266 extending through clearance holes 268 formed in the upper shank portion of the stub member that overlaps the lower end of the upper arm 252 to engage within aligned threaded holes formed in the upper arm. The stub member also includes an enlarged, circular, lower head portion that bears against one side of a circular spacer 256 which is used to replace drive gear 30. The pivot joint 250 also has a lower pivot arm 258 corresponding to arm 16 which is detachably connectible to a stub member 260 with screws 270. As with stub member 254, the stub member 260 includes an enlarged, circular head portion to abut against the opposite side of spacer 256. Ideally, the pivot joint 250 utilizes the same pivot shaft 90 shown in FIG. 5, as well as the same snap ring 98 to maintain the shaft in engagement with the stub members 254 and 260 and the spacer 256.

For use in conjunction with the embodiment of the present invention shown in FIG. 8, the fluid cylinder assembly 26 and its associated drive mechanism is mounted on a subframe having stub members that are detachably engageable with the upper arm 252 and the lower arm 260 so that the subassembly may be simply substituted for pivot joint 250 as desired.

As also shown in FIG. 8, the distance between the upper cuff assembly 18 and the pivot axis 17 may be adjusted by simply removing screws 266 and then reattaching the stub member 254 to upper pivot arm 254 reengaging the screws in another set of tapped holes 268 formed in upper arm 252. Likewise, the distance between the lower cuff assembly 20 and the pivot axis 17 may be varied by removing lower screws 270 and then reattaching the stub member 260 to the lower pivot arm 258 by reengaging the screws into a different set of tapped holes 272 formed in the lower arm. By this construction, apparatus 10 may be adjusted to accommodate wearers of different size.

In an additional preferred embodiment of the present invention shown in FIG. 9, a lower cuff assembly 20' is attached to the lower end of pivot arms 280*a* and 280*b* so as to permit the cuff assembly to "float" toward and away from the pivot axis 17 as the body joint is being flexed or extended. This embodiment of the present invention accommodates the fact that a knee joint approximates but is not exactly analogous to a simple hinge joint and also that it may not be possible to always align the pivot axis 17 of apparatus 10 at exactly the pivot axis of the knee joint. As such, it may be desirable to allow the upper and lower cuff assemblies to freely move toward and away from each other as the apparatus 10 is being utilized. To this end, the lower cuff assembly 20' is attached to the lower ends of the pivot arms 280*a* and 280*b* by pins 282 which extends through close-fitting, vertically elongated slots 284 formed in the lower ends of the arms. The pins 282 are formed with enlarged head portions 286 to prevent the pin from disengaging from the arms 280*a* and 280*b*. In all other respects, the embodiment of the present invention shown in FIG. 9 is substantially the same as shown in FIGS. 1–5.

FIGS. 10 and 11 illustrate a further preferred embodiment of the present invention illustrating an alternative construction of the cuff assembly 20 shown in FIG. 1 and the cuff assembly 20' shown in FIG. 9. The cuff assembly 20" shown in FIGS. 10 and 11 includes a formed, forward shell member shaped to encircle the forward portion of the calf. The side portions of the forward shell member are pivotally attached to the lower ends of the lower pivot arms 16*a'* and 16*b'* by pivot pins 302 which extend through close-fitting, vertically elongated slots 304 formed in the lower ends of the arms 16*a'* and 16*b'*. The pins 302 are formed with enlarged head portions 306 to prevent the pins from disengaging from the arms 16*a'* and 16*b'*. The lower cuff assembly 20" also includes a rearward, formed shell member 308 for encircling the rearward portion of the lower thigh of the wearer. The "inside" edge portion of the rearward shell member 308 is hinged to the adjacent edge portion of the forward shell member with a flexible hinge member 310 which is secured to the two shell members by any convenient method. A quick release latch assembly 312 is secured to the outward side edge portions of the forward and rearward shell members 308. As with latch assembly 58, discussed above, the latch assembly 312 may be of any appropriate construction and includes a latch or buckle 314 mounted on either the forward or rearward shell member to engage with a corresponding strap 316 mounted on the other shell member.

As with shell members 42 and 44 discussed above, ideally to minimize weight of the cuff assembly 20" and to provide ventilation, slots 318 or other types or shapes of openings are formed in the shell members 300, 308. Resilient padding 320 and 322 is mounted on the inside surfaces of the shell members 300, 308, respectively, to provide comfort to the wearer and to snugly fit the cuff assembly 18 around the leg. The padding may be composed of appropriate resilient materials, such as foam rubber or plastic. As an alternative or in addition to the padding 312, 322, an air bladder, not shown, may be used. The air bladder could be provided with a standard valve and stem for directing air into and out of the bladder.

It will be appreciated that by the foregoing construction of the lower cuff member 20" in conjunction with the construction of the upper cuff member 18, discussed above, the wearer may conveniently gain "rear entry" to the apparatus. The latch assemblies 58 and 312 may be detached so that the rear shell members 44 and 308, respectively are pivoted into open position. Thereafter, the apparatus may be simply laid over the forward portion of the wearer's leg and then the rear shell members 44 and 308 closed around the rearward portions of the legs and conveniently latched to the corresponding forward shell members 42 and 300, respectively. This construction eliminates the need to "pull" or "draw" the apparatus up the leg from the foot.

It is to be appreciated that in all the various embodiments of the present invention discussed above and illustrated in FIGS. 1–11, the width of apparatus 10 is kept to a minimum to thus avoid interference with other body members. Also, by locating the cylinder assembly 22 on the extendible side of the knee joint, the cylinder assembly is out of the way and does not hamper the ability of the knee joint to be fully flexed. By this construction, the apparatus 10 may be utilized not only when performing specific exercises, but also during regular daily activities, whether at home or at work. As such, a specific time period does not have to be devoted to exercising a desired body joint, but rather the joint is exercised during normal body movements.

As will be apparent to those skilled in the art to which the invention is addressed, the present invention may be embodied in forms other than those specifically disclosed above and may be adapted for use with other body joints, such as the ankle or wrist joints, without departing from the spirit or scope of the present invention. The particular embodiments of the exercise apparatus 10 set forth above, are therefore to be considered in all respects as illustrative and not restrictive. The scope of the present invention is as set forth in the appended claims rather than being limited to the examples of the apparatus 10 set forth in the foregoing description.

The embodiments of the invention in which an exclusive property or privilege is claimed are defined as follows:

1. A portable appliance for selectively imparting desired levels of resistance to the flexing and extending of a body joint, comprising:

(a) an articulating frame structure carried by the body, said frame structure comprising:
a first pivot arm;
a second pivot arm; and,
means for pivotally interconnecting the first and second pivot arms to pivot the first and second pivot arms about a pivot axis in a first relative direction and in a second relative direction opposite to the first relative direction;

(b) first means for mounting the frame on the body to attach the first and second pivot arms to respective first and second pivotally connected limbs of the body to place the pivot axis of the first and second pivot arms in approximate alignment with the pivot axis of the body joint;

(c) fluid resistance means to resist the relative pivotal movement between the first and second pivot arms;

(d) second means for mounting the fluid resistance means at a location spaced from and generally parallel with the pivot axis of the body joint; and, (e) transmission means for transmitting the relative rotational movement of the first and second pivot arms to the resistance means to actuate the resistance means to generate a resistive load to the relative pivotal movement between the first and second pivot arms.

2. The portable appliance according to claim 1, wherein the second mounting means mount the resistance means along the pivot axis on the extendible side of the body joint.

3. The portable appliance according to claim 2, wherein the second mounting means mount the resistance means on the frame.

4. The portable appliance according to claim 3, wherein the second mounting means mount the resistance means on one of the first and second pivot arms of the frame.

5. The portable appliance according to claim 1, wherein the resistance means are rotationally actuated.

6. The portable appliance according to claim 1, wherein the fluid resistance means includes a fluid cylinder assembly operable by the relative rotational movement between the first and second arms as transmitted to the cylinder assembly by the transmission means.

7. The portable appliance according to claim 6, wherein the fluid cylinder assembly is rotatably actuated.

8. The portable appliance according to claim 7, wherein the fluid cylinder assembly:

(a) includes a first cylinder, a piston disposed therein and a piston rod connected to the piston and extending longitudinally through the cylinder; and, (b) is rotatably actuated by rotation of the piston rod thereby to slide the piston along the cylinder.

9. The portable appliance according to claim 8, wherein the piston rod and a piston are threadably engaged with each other.

10. The portable appliance according to claim 8, wherein the transmission means include:

(a) a first pulley mounted on one of the first and second arms;

(b) a second pulley connected to the piston rod; and, (c) belt means for rotatably interconnecting the first and second pulleys.

11. The portable appliance according to claim 6, wherein the fluid cylinder assembly includes a first cylinder, a piston slidably disposed in the first cylinder, a piston rod connected to the piston and extending longitudinally through the first cylinder and combination means for both recirculating the fluid in the first cylinder from one side of the piston to the other as the piston moves along the first cylinder and to serve as a reservoir for the fluid.

12. The portable appliance according to claim 11, wherein the combination means include an annular chamber surrounding the first cylinder, the annular chamber being in fluid flow communication with the end portions of the first cylinder.

13. The portable appliance according to claim 11, wherein the fluid cylinder assembly further comprises adjustable flow control means for controlling the flow of the fluid between each end of the first cylinder and the combination fluid recirculation and storage means to independently control the level of effort required to rotate the first and second arms in the first relative direction and the second relative direction.

14. The portable appliance according to claim 13, wherein the adjustable flow control means controls the fluid flow between each end of the first cylinder and the combination fluid recirculation and storage means to cause the cylinder assembly to impart a constant resistance load against the relative rotation of the first and second arms.

15. The portable appliance according to claim 13, wherein the adjustable flow control means controls the flow of fluid between each end of the first cylinder and the combination fluid recirculation and storage means to limit the speed at which the first and second arms are rotatable relative to each other.

16. The portable appliance according to claim 13, wherein the adjustable flow control means controls the flow of fluid between each end of the first cylinder and the combination fluid recirculation and storage means to impart a resistance load on the first and second arms of a level proportionally related to the speed at which the first and second arms are moved relative to each other.

17. The portable appliance according to claim 1, wherein the first mounting means include a first cuff assembly connected to the first pivot arm to detachably encircle one of the limbs of the joint, and a second cuff assembly attached to the second pivot arm to detachably encircle the second limb of the joint.

18. The portable appliance according to claim 17, wherein the second cuff assembly is pivotally attached to the second pivot arm to enable the second cuff assembly to accommodate the shape of the portion of the second limb encircled by the second cuff assembly.

19. The portable appliance according to claim 17, further comprising means for adjusting the distance between at least one of the cuff assemblies and the pivot axis of the frame.

20. The portable appliance according to claim 19, further comprising means for enabling the distance separating the pivot axis and at least one of the two cuff assemblies to be automatically and continuously varied during use of the portable appliance.

21. The portable appliance according to claim 17, wherein:

the first cuff assembly includes a formed, forward shell member attached to the first pivot arm to encircle the forward portion of the first limb;

a formed, rear shell member having a first side edge portion disposed alongside an adjacent portion of the forward shell member and attached to the first pivot arm, the rear shell member having a second side edge portion and shaped to encircle the rear portion of the first limb; and, latch means for latching the second side edge portion of the rear shell member to an adjacent portion of the forward shell member.

22. The portable appliance according to claim 21, wherein:

the second cuff assembly includes a formed, forward shell member attached to the second pivot arm and shaped to encircle the forward portion of the second limb;

a formed, rear shell member having a first side edge portion attached to the second pivot arm, said second shell member having a second side edge portion and shaped to encircle the rear portion of the second limb; and, latch means for detachably latching the second side edge portion of the rear shell to an adjacent portion of the forward shell.

23. The portable appliance according to claim 22, wherein at least one of the first and second cuff assemblies includes removable, resilient pads disposed within the cuff assembly to accommodate the size and shape of the limb.

24. The portable appliance according to claim 22, wherein at least one of the first and second cuff assemblies includes a fluid bladder disposed within the cuff assembly to at least partially surround the limb, said fluid bladder being expandable and contractable to accommodate the size and shape of the limb.

25. A portable appliance for exercising a body joint, comprising:

(a) a first pivot arm;
(b) a second pivot arm;
(c) means for pivotally interconnecting the first and second pivot arms about a pivot axis;
(d) first means for mounting the first and second pivot arms to respective first and second pivotally connected limbs of the body to place the pivot axis in approximate aligment with the pivot axis of the body joint;
(e) fluid resistance means carried by the body to resist relative pivotal movement between the first and second pivot arms;
(f) second means for mounting the fluid resistance means at a location spaced from and generally parallel with the pivot axis of the body joint; and,
(g) transmission means for transmitting the relative rotational movement between the first and second pivot arms to the fluid resistance means to actuate the resistance means to generate a resistive load to the relative pivotal movement between the first and second pivot arms and, thus, generating a resistive force against the flexing and extending of the body joint.

26. The portable appliance according the claim 25, wherein the resistance means are mounted on one of the two arms and the transmission means includes a drive member mounted on the other of the first and second arms and rotatable in response to the relative rotation between the first and second arms, the transmission means further including means for transmitting the rotational movement of the drive means to the resistance means for actuation of the resistance means.

27. The portable appliance according to claim 26, wherein:

the drive member include a first pulley; and,
the transmission means further includes a second pulley connected to the resistance means and a belt trained on the first and second pulleys to transmit torque therebetween.

28. The portable appliance according to claim 26, wherein the resistance means includes a double-acting, fluid cylinder assembly, comprising a first cylinder, a piston mounted on a piston rod to slide within the first cylinder, wherein the piston rod is connected to the transmission means.

29. The portable appliance according to claim 28, wherein:

the drive member includes a first pulley; and,
the transmission means further comprising a second pulley connected to the piston rod and a belt trained on the first and second pulleys for transmitting torque therebetween.

30. The portable appliance according to claim 29, wherein the piston rod and piston are threadably engaged whereby rotation of the piston rod results in sliding movement of the piston longitudinally within the cylinder.

31. The portable appliance according to claim 26, wherein the cylinder assembly includes a second cylinder surrounding the first cylinder to form an annular chamber about the first cylinder, and means for interconnecting the end portions of the first cylinder on opposite sides of the piston with the annular chamber, whereby fluid from the first cylinder is transmitted through the annular chamber from one side of the piston to the other side as the piston moves along the first cylinder.

32. The portable appliance according to claim 31, further comprising flow control means for controlling the flow of the fluid between the first cylinder and the annular chamber thereby to control the movement of the piston within the first cylinder.

33. The portable appliance according to claim 32, wherein the flow control means imparts a constant force against the movement of the piston within the cylinder.

34. The portable appliance according to claim 32, wherein the flow control means permits the piston to move at a constant speed within the cylinder.

35. The portable appliance according to claim 32, wherein the flow control means imparts a resistance force on the piston in proportion to the speed of movement of the piston within the cylinder.

36. The portable appliance according to claim 25, wherein the first mounting means include a first cuff assembly connected to the first pivot arm to detachably encircle one of the limbs of the joint, and a second cuff assembly attached to the second pivot arm to detachably encircle the second limb of the joint.

37. The portable appliance according to claim 36, further comprising means for adjusting the distance between one of the cuff assemblies and the pivot axis of the frame.

38. The portable appliance according to claim 36, further comprising means for adjusting the distance between the first cuff assembly and the pivot axis of the frame and also the distance between the second cuff assembly and the pivot axis.

39. The portable appliance according to claim 36, further comprising means for enabling the distance separating the pivot axis of the frame and at least one of the two cuff assemblies to be automatically and continuously varied during use of the portable appliance.

40. The portable appliance according to claim 36, wherein at least one of the first and second cuff assemblies includes a fluid bladder to at least partially surround a corresponding limb.

41. The portable appliance according to claim 36, wherein the second cuff assembly is pivotally mounted to the second pivot arm to adjust to the shape of the portion of the second limb being encircled by the second cuff assembly.

42. The portable appliance according to claim 36, wherein at least one of the first and second cuff assemblies is composed of:

a forward shell member connected to its respective pivot arm and shaped to encircle the forward portion of a limb;
a rearward shell member having a first side portion connected to the adjacent side portion of the forward shell member, said rearward shell member shaped to encircle the rearward portion of the limb; and,
latch means for detachably latching the second side portion of the rearward shell member to the corresponding side edge of the forward shell member.

43. The portable appliance according to claim 42, further comprising resilient padding detachably securable to the interior of the forward and rearward shell members.

* * * * *

UNITED STATES PATENT AND TRADEMARK OFFICE

CERTIFICATE OF CORRECTION

PATENT NO. : 4,801,138

DATED : January 31, 1989

INVENTOR(S) : James F. Airy, Thomas D. Kadavy

It is certified that error appears in the above-identified patent and that said Letters Patent is hereby corrected as shown below:

Citation of References

Page 1, in the "References Cited" section add the following references:

| | | | |
|---|---|---|---|
| 2,714,507 | 8/1955 | Goodrich | 272 |
| 2,777,439 | 1/1957 | Tuttle | 128 |
| 2,791,920 | 5/1957 | Ray | 188 |
| 2,832,334 | 4/1958 | Whitelaw | 272 |
| 3,495,824 | 2/1970 | Cuinier | 272 |
| 3,964,742 | 6/1976 | Carnielli | 128 |
| 4,407,496 | 10/1983 | Johnson | 272 |
| 4,436,303 | 3/1984 | McKillip et al. | 272 |
| 747,473 | 7/1980 | Soviet Union | 272 |

Signed and Sealed this

Thirteenth Day of March, 1990

*Attest:*

*Attesting Officer*

JEFFREY M. SAMUELS

*Acting Commissioner of Patents and Trademarks*